United States Patent [19]

Johnson

[11] Patent Number: 4,643,801

[45] Date of Patent: Feb. 17, 1987

[54] PAPERMAKING AID

[75] Inventor: Kerrie A. Johnson, Mount Prospect, Ill.

[73] Assignee: Nalco Chemical Company, Oak Brook, Ill.

[21] Appl. No.: 832,557

[22] Filed: Feb. 24, 1986

[51] Int. Cl.[4] ..... D21H 3/28; D21H 3/36

[52] U.S. Cl. ..... 162/164.1; 162/164.5; 162/164.6; 162/168.1; 162/168.2; 162/168.3; 162/168.4; 162/168.5; 162/168.6; 162/175; 162/181.1; 162/181.2; 162/181.3; 162/181.4; 162/181.5; 162/181.6; 162/183

[58] Field of Search ..... 162/181.6, 175, 181.1, 162/168.2, 168.3, 164.6, 164.5, 168.4, 168.5, 183, 168.1, 168.6, 181.2, 181.3, 181.4, 181.5

[56] References Cited

U.S. PATENT DOCUMENTS 3,253,978 5/1966 Bodendorf et al. ..... 162/181.1
4,385,961 5/1983 Svending et al. ..... 162/181.1

FOREIGN PATENT DOCUMENTS

WO83/01970 6/1983 PCT Int'l Appl. ..... 162/180

*Primary Examiner*—Peter Chin
*Attorney, Agent, or Firm*—John G. Premo; Donald G. Epple; Anthony L. Cupoli

[57] ABSTRACT

An improved binder for use in paper-making contains three ingredients, a cationic starch having a degree of substitution of at least 0.01, a high molecular weight anionic polymer having a molecular weight of at least 500,000 and a degree of anionic substitution of at least 0.01, and a dispersed silica having a particle size ranging from between about 1-50 nanometers.

13 Claims, 4 Drawing Figures

PAPERMAKING AID

INTRODUCTION

The present invention relates to paper-making processes and products made thereby and, more particularly, to the use of a specific coacervate binder to achieve better binding between cellulosic fibers used in paper-making processes using cellulosic fiber slurries, particularly when those slurries also contain various inorganic fillers and/or pigment materials characterized by having an electrically charged surface character.

The use of the binders of this invention allows the papermaker to operate at a higher speed because the paper sheet formed is more easily dewatered. In addition, improved retention of added mineral materials used in paper-making processes, such materials being various clays, $TiO_2$ and other pigments, and the like, is achieved by using the coacervate binders of my invention. Because improved retention and improved dewatering are observed using the improved binders of this invention, it is also an object of this invention to improve clarification of the white water resulting from the paper-making processes using the improved binders of this invention.

It is, therefore, an object of this invention to present to the papermaker an improved coacervate binder which can achieve both improved dewatering and improved retention of mineral fillers and pigments used in the paper-making process.

Another object of this invention is to achieve a paper having improved strength characteristics.

It is another object of this invention to present to the papermaker an improved coacervate binder comprising a tertiary combination of a cationic starch, an anionic high molecular weight polymer, and a dispersed silica, which binder can achieve improved dewatering, improved mineral pigment retention, and improved operating speeds of the paper-making machine without loss in paper strength or other familiar characteristics required in a paper sheet.

Other objects will become apparent.

PRIOR PRACTICES

U.S. Pat. No. 3,253,978, Bodendorf et al, teaches a method of forming an inorganic water-laid sheet containing colloidal silica and a cationic starch. This invention combines colloidal silica and a cationic agent, preferably a cationic starch in the head box of a paper-making machine which is manufacturing a strictly inorganic fibrous sheet. The type of paper being manufactured is, therefore, referred to as an inorganic sheet and utilizes inorganic fibers, such as glass fibers, quartz fibers, ceramic fibers, mineral wool, glass flakes, quartz flakes, mica flakes and combinations thereof. In column 4, lines 53 at seq., of Bodendorf et al., teach that organic fibers may also be incorporated in the sheet but that the presence of substantial percentages of these organic materials in these kinds of sheet products are considered deleterious for intended applications of these inorganic sheets.

U.S. Pat. No. 4,385,961, Svendling, et al, teaches a paper-making process in which a cellulosic pulp is formed, and in which a binder is used, which binder comprises a colloidal silicic acid and a cationic starch. The manner of addition is taught to involve the initial addition of a portion of a colloidal silicic acid to the paper-making stock followed subsequently by the addition of cationic starch, which then is followed, finally, by the addition of the remainder of the colloidal silicic acid prior to the formation of the paper sheet.

U.S. Pat. No. 4,388,150, Sunden, et al, continues to teach the use of a binder comprising colloidal silicic acid and cationic starch for improving paper and the retention of various paper stock components.

THE INVENTION

I have found an improved paper-making process in which an aqueous paper-making stock containing at least 50% cellulosic pulp is formed into a sheet and then dried, said sheet comprising at least 50 weight percent cellulosic fiber, wherein the papermaking stock includes from 0.1 to 15 weight percent of a binder, which binder comprises a cationic starch having a degree of substitution ranging between 0.01 and 0.20 in combination with an anionic mixture of a high molecular weight anionic polymer and a dispersed silica [having an average particle size ranging between about 1 and 50 nanometers (nm)], wherein the combination of anionic polymer to silica sol has a weight ratio of polymer to silica sol ranging between about 20:1 to about 1:10.

The use of the binder described above is preferably accomplished by adding to the beater or mixer a cationic starch having a cationic substitution ranging between 0.01 and 0.15, which cationic starch is preferably derived from a modified potato starch, which potato starch normally contains some small amount of covalently bound phosphorous containing functional groups and is of a highly branched amylopecton type of starch. However, it must be pointed out that other cationically modified starches, for example, cationic starch derived from corn starch, cationic starches derived from waxy maize, and the like, may be used in the practice of my invention and in the formulation of our improved binder, as long as the degree of cationic substitution on the starch ranges from about 0.01 to about 0.20, preferably between about 0.02 to about 0.15, and most preferably between about 0.025 to about 0.10.

To the cationic starch admixed with cellulosic fibers, preferably in the head box of a paper-making machine, is added a quantity of an admixture of a high molecular weight anionic polymer and a dispersed silica, which admixture contains a ratio of anionic polymer to dispersed silica ranging between about 20:1 to about 1:10 on a weight-to-weight basis. This coacervate binder may be formed by initially admixing the cationic starch with the cellulosic fiber slurry used in the paper-making process. After the cationic starch has been fully admixed, an electroneutralizing amount of the admixture of anionic polymer and dispersed silica may be then added to the paper-making stock containing the cationic starch.

By an electroneutralizing amount of the anionic combination, we mean that sufficient amounts of the combination of both the anionic polymer and the dispersed silica should be added to the paper-making stock containing the cationic starch in such a way as to approach within 75 to 125 percent of electroneutrality. Depending on the character of the cellulosic fiber, the type, amount and character of inorganic filler/pigment, as well as the character of the cationic starch, this electroneutralizing amount of anionic combined ingredients can be achieved by adding anywhere from about 75 to 125 percent of an electroneutralizing amount of the combination of anionic polymer and silica sol to the cationically modified starch/paper stock admixture. On a weight basis, this will vary considerably depending upon the ratio of anionic polymer to silica sols, as well as depending upon the type of anionic polymer chosen and the type of silica dispersion chosen. It will also vary according to the character, type, amount and the like of cationic starch used, as well as the types of fiber, fillers, and the like, used to form to paper stock.

Sunden, et al, U.S. Pat. No. 4,388,150, teaches the use of a weight ratio of cationic starch to silica ranging between 1:1 and 25:1. Sunden, et al, is hereby incorporated herein by reference.

Svendling, et al, U.S. Pat. No. 4,385,961, which is hereby incorporated herein by reference, again teaches a weight ratio of cationic starch to silica ranging between 1:1 to 25:1 in a binder use which is improved by first adding colloidal silicic acid and then a cationic starch, forming an oglomerate, and then adding a remainder of colloidal silicic acid to the paper-making stock prior to the formation of the paper sheet. This complicated procedure normally requires that the first portion of colloidal silicic acid comprises between 20–90 percent of the total colloidal silicic acid added to the paper-making stock.

The improved coacervate binder of this invention uses a combination of cationic starch, preferably a cationically modified potato starch having a degree of cationic substitution ranging between about 0.02 to about 0.15, wherein said potato starch also contains naturally, not synthetically, bound phosphorous containing functionality, with an electroneutralizing amount of the combination of a high molecular weight anionic polymer and a dispersed silica wherein the dispersed silica has a particle size ranging between about 1.0 nanometers to about 50 nanometers.

The combination of anionic polymers to dispersed silica preferably a colloidal silicic acid or a colloidal silica sol normally ranges within a weight ratio of between 20:1 to about 1:10, and, most preferably, ranges between a weight ratio of anionic polymer to silica of from about 15:1 to about 1:1.

The Anionic Polymers

The anionic polymers used are preferably high molecular weight water soluble polymers having a molecular weight of at least 500,000, preferably a molecular weight of at least 1,000,000 and most preferably having a molecular weight ranging between about 5,000,000–25,000,000.

These anionic polymers are preferably water-soluble vinylic polymers containing monomers from the group acrylamide, acrylic acid, AMPS and/or admixtures thereof, and may also be either hydrolyzed acrylamide polymers or copolymers of acrylamide or its homologues, such as methacrylamide, with acrylic acid or its homologues, such as methacrylic acid, or perhaps even with monomers, such as maleic acid, itaconic acid or even monomers such as vinyl sulfonic acid, AMPS, and other sulfonate containing monomers. The anionic polymers may be homopolymers, copolymers, terpolymers or contain multiple monomeric repeating units. The anionic polymers may also be sulfonate or phosphonate containing polymers which have been synthesized by modifying acrylamide polymers in such a way as to obtain sulfonate or phosphonate substitution, or admixtures thereof. The anionic polymers may be used in solid, powder form, after dissolution in water, or may be used as water-in-oil emulsions, wherein the polymer is dissolved in the dispersed water phase of these emulsions.

It is preferred that the anionic polymers have a molecular weight of at least 1,000,000. The most preferred molecular weight is at least 5,000,000, with best results observed when the molecular weight is between 7.5–25 million. The anionic polymers have a degree of substitution of at least 0.01, preferably a degree of substitution of at least 0.05, and most preferably a degree of substitution of at least 0.10–0.50. By degree of substitution, we mean that the polymers contain randomly repeating monomer units containing chemical functionality which when dissolved in water become anionically charged, such as carboxylate groups, sulfonate groups, phosphonate groups, and the like. As an example, a copolymer of acrylamide (AcAm) and acrylic acid (AA) wherein the AcAm:AA monomer mole ratio is 90:10, would have a degree of substitution of 0.10. Similarly, copolymers of AcAm:AA with monomer mole ratios of 50:50 would have a degree of anionic substitution of 0.5.

The Dispersed Silica

Preferably, the anionic polymers are used in combination with a dispersed silica having a particle size ranging between about 1–50 nanometers (nm), preferably having a particle size ranging between 2–25 nm, and most preferably having a particle size ranging between about 2–15 nm. This dispersed silica may be in the form of colloidal silicic acid, silica sols, fumed silica agglomerated silicic acid, silica gels, and precipitated silicas, as long as the particle size or ultimate particle size is within the ranges mentioned above. The dispersed silica is normally present at a ratio of cationic starch to silica of from about 100:1 to about 1:1, and is preferably present at a rate of from 75:1 to about 30:1.

This combined anionic admixture is used within a dry weight ratio of from about 20:1 to about 1:10 of anionic polymer to silica, preferably between about 10:1 to about 1:5, and most preferably between about 8:1 to about 1:1.

The Anionic Combination

When the anionic combination (or anionic admixture) is used in my invention, it is preferable to add the polymer and dispersed silica to the paper-making stock after the addition of the cationic starch has occurred, and sufficient time and mixing energy used to accomplish a thorough homogeneous admixture of cationic starch and the cellulosic slurries, mineral fillers, clays, pigments, and other inorganic components of the paper-making stock.

The anionic admixture is then added so as to essentially accomplish an electroneutralization of the cationic charges contained in the paper stock. Since the cellulosic fibers, and most inorganic pigments and clays, such as $TiO_2$ pigment, normally carry a negatively charged surface, it is a relatively simple matter to calculate electroneutrality on the basis of the amount of cationic starch added, the degree of substitution of cationic functionality on the starch added, and the amount of any other additional species carrying a cationic charge which may be present in the paper stock, i.e., alumina sols, alum, and the like.

Depending on the molecular weight, degree of anionic substitution, and type of polymer used, as well as on the amount and type of cationic starch used, the starch to polymer weight ratio can range from about 50:1 to about 5:1. Simultaneously, the polymer to silica ratio normally runs from about 20:1 to about 1:10, and, as before, preferably ranges from about 10:1 to about 1:5, and most preferably ranges between about 8:1 to 1:1. The most preferred results are obtained when the starch to silica ratios range from about 75:1 to about 30:1.

The anionic combination or admixture of anionic polymer to silica, as described above, can be made prior to admixture with the paper stock containing the cationic starch, and then added to the paper stock, or preferably is made in situ during the paper-making process by adding to the paper stock, in sequence, the cationic starch, then the anionic polymer, and finally the dispersed silica.

It is believed that a coacervate complex of undetermined structure is formed, in the presence of the paper stock and which may include components of the paper stock, between the cationic starch and the anionic polymer, and that this pre-coacervate complex contains, therein, at least some positive charges, which positive charges can then attract and bind both the added dispersed silica which carries a negative surface charge, as well as the cellulosic fibers, inorganic pigments, and the like. It is presumed that the formation of the coacervate complex between starch, polymer; and silica leads to the improved performance observed with my system relative to the use of any other combination of ingredients known in the art, such as only starch plus silica. Although it would be difficult to demonstrate that this mechanism exactly accounts for the improved performance observed, and my invention should not be limited in any way to my attempted mechanistic explanation, it is a simple matter to demonstrate the improved performance of my three component coacervate binder system.

Figure 1:
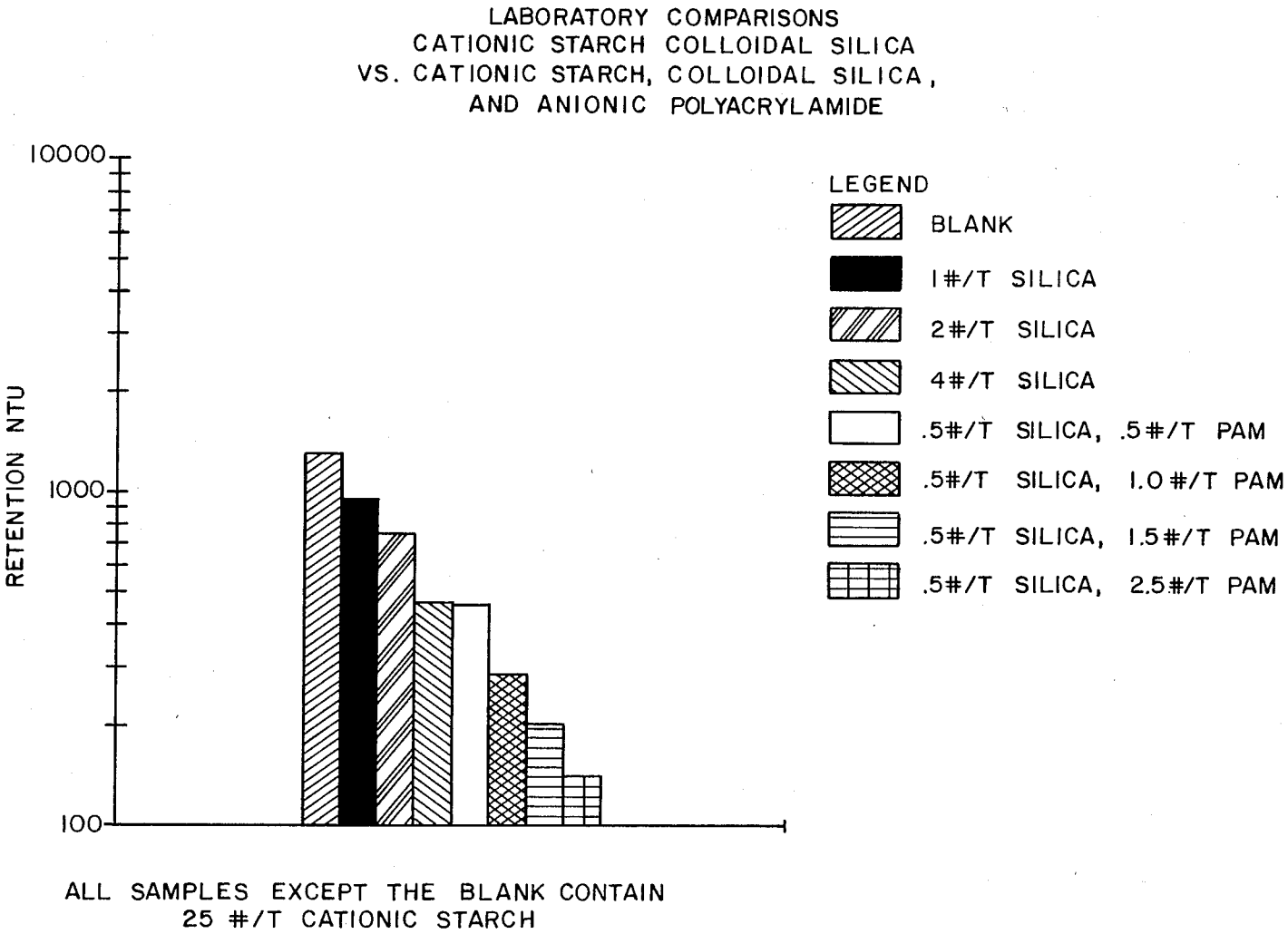
FIG. 1 compares the effect on retention between the use of cationic starch and colloidal silica, and cationic starch, colloidal silica and anionic polyacrylamide.
Figure 2:
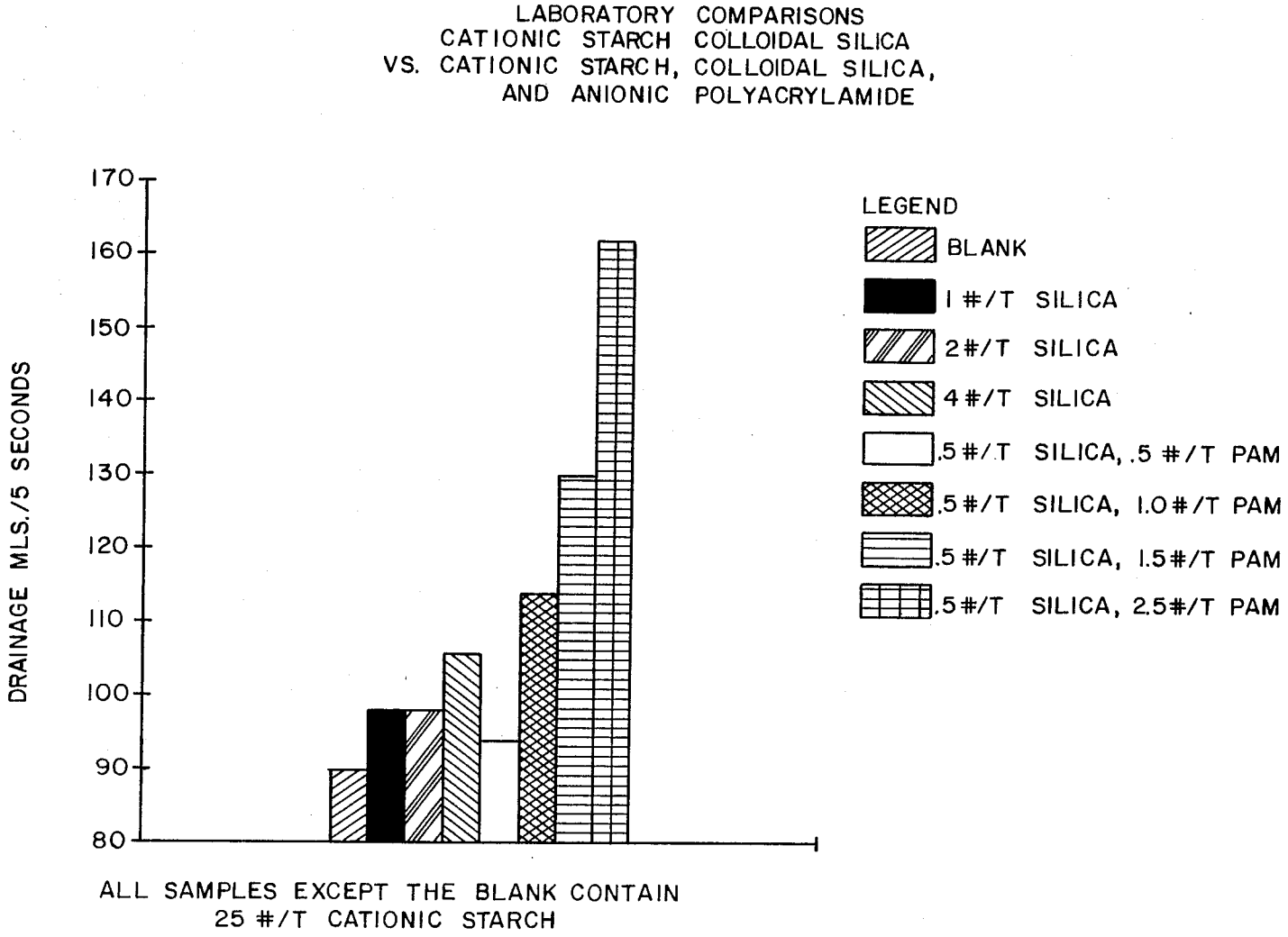
FIG. 2 compares the effect on drainage between the use of cationic starch and colloidal silica, and cationic starch, colloidal silica and anionic polyacrylamide coacervate binder.
Figure 3:
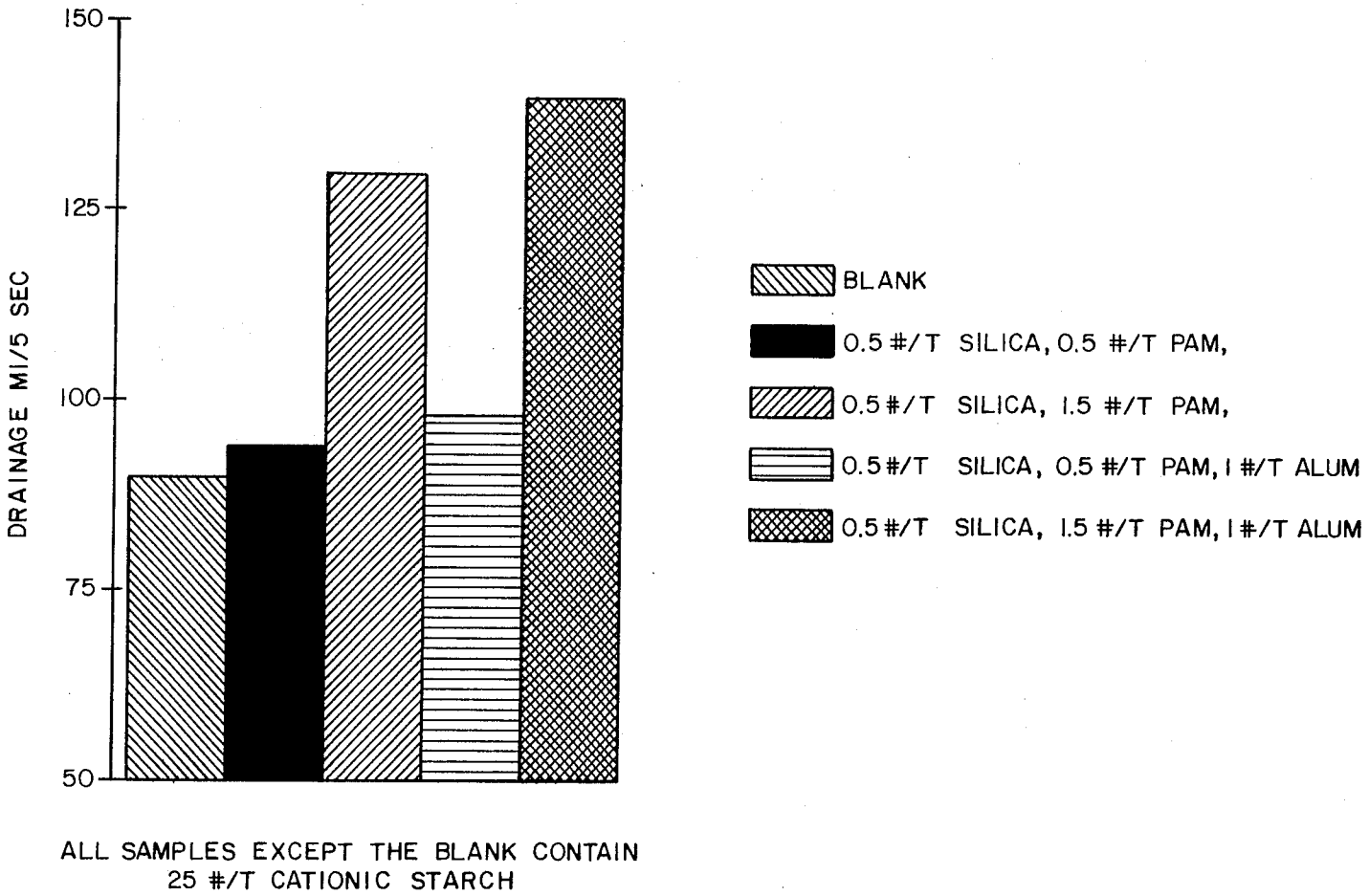
FIG. 3 shows the effect on the drainage of adding polyhydroxyaluminum chloride in addition to the inventive three component coacervate binder.
Figure 4:
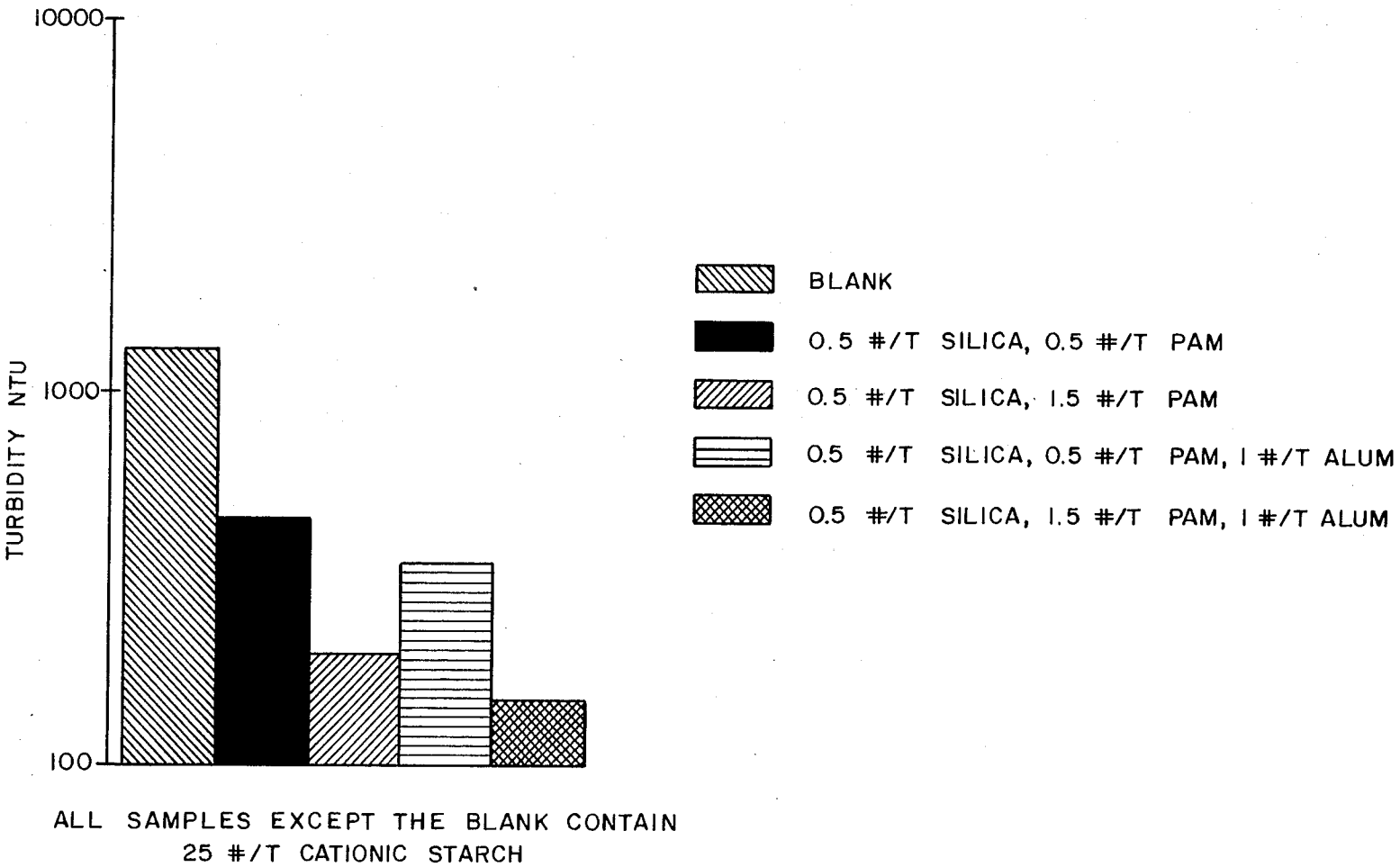
FIG. 4 shows the effect on retention of adding polyhydroxyaluminum chloride in addition to the inventive three component coacervate binder.

The following examples should suffice to demonstrate my new binding system, methods and compostiions.

EXAMPLE I

Paper stock was prepared at 0.7% consistency from a thick paper stock (3.8% cellulosic fibers) and clarified white water obtained from a paper mill. The stock had a pH of 7.0–7.5.

Cationic potato starch having a degree of substitution of 0.025 was prepared at a 2.0 weight percent solution in water, and diluted further, immediately prior to application to a concentration of 0.875%.

A high molecular weight (about 10–20 million) anionic polyacrylamide containing about 30 mole percent acrylic acid and 70 mole percent acrylamide monomer, in the form of a water-in-oil latex containing about 30 weight percent polymer was inverted and diluted into water following the teachings of Anderson, et al, U.S. Pat. No. Re 28,474 and U.S. Pat. No. Re 28,576, both of which are incorporated herein by reference. The polymer solution was made up at 2.0 weight percent active polymer and further diluted to 0.0875 weight percent immediately prior to use.

A 15 weight percent silica sol (or colloidal silica) having a particle size of about 4 nm was diluted with water to 0.0875 weight percent. Two separate batches of paper stock were obtained from the same mill approximately two weeks apart.

The paper stock was admixed with cationic starch and then the various amounts of anionic polymers and/or silica sol were added thereto. Laboratory tests were completed using an "Alchem Tester", which is designed to measure both water drainage rates under controlled conditions and also turbidity (NTU) which is related to retention by the formula:

$$\% \text{ Retention} = (\text{Turbidity (Blank)} - \text{Turbidity (Sample)})/\text{Turbidity (Blank)} \times 100$$

The data from these tests are presented in Tables I and II.

Table I presents data from the first paper stock.

Table II presents data from the second paper stock.

TABLE I

| Starch #/T | Silica #/T | PAM* #/T | Drainage (ml/5 sec) | Turbidity** (NTU) |
|---|---|---|---|---|
| 0 | 0 | 0 | 112 | 1640 |
| 25 | 0 | 0.5 | 126 | 390 |
| 25 | 0 | 1 | 148 | 200 |
| 25 | 0 | 2 | 182 | 105 |
| 25 | 0 | 3 | 178 | 100 |
| 0 | 0 | 1 | 111 | 445 |
| 0 | 0 | 2 | 108 | 420 |
| 0 | 0 | 3 | 106 | 405 |
| 25 | 2 | 0 | 128 | 360 |
| 25 | 5 | 0 | 142 | 215 |
| 25 | 7 | 0 | 153 | 180 |

The two component PAM and starch combination is superior to both starch/silica and the PAM alone, for retention* and drainage.

*PAM - An anionic polyacrylamide containing about 30% acrylic acid and having a molecular weight in excess of 10,000,000.

**An increase in retention is indicated by a decrease in turbidity.

TABLE II

| Starch #/T | Silica #/T | PAM* #/T | Drainage (ml/5 sec) | Turbidity (NTU) |
|---|---|---|---|---|
| 0 | 0.00 | 0.0 | 90 | 1312.5 |
| 5 | 0.00 | 0.0 | 90 | 1280 |
| 15 | 0.00 | 0.0 | 90 | 1325 |
| 25 | 0.00 | 0.0 | 94 | 1375 |
| 35 | 0.00 | 0.0 | 86 | 1500 |
| 25 | 0.00 | 1.0 | 114 | 300 |
| 25 | 0.25 | 1.0 | 110 | 300 |
| 25 | 0.50 | 1.0 | 114 | 280 |
| 25 | 0.75 | 1.0 | 116 | 270 |
| 25 | 0.00 | 1.0 | 114 | 300 |
| 25 | 0.00 | 2.0 | 134 | 180 |
| 25 | 0.00 | 3.0 | 154 | 140 |
| 25 | 0.50 | 0.5 | 94 | 460 |
| 25 | 0.50 | 1.0 | 114 | 280 |
| 25 | 0.50 | 1.5 | 130 | 200 |
| 25 | 0.50 | 2.5 | 162 | 140 |

*PAM - The same high molecular weight anionic copolymer of acrylamide/acrylic acid as used in Table I.

The three (3) component coacervated system: starch; anionic polymer; and dispersed silica provides superior retention and drainage as compared with the two component starch/silica binder systems taught in the prior art. The starch/polymer system alone gives comparable results when compared to the starch/silica system of the prior art for some of the drainage tests. Overall, the three component coacervate binder is superior in both retention and drainage.

These tests are further illustrated in FIGS. I and II.

Example II

The addition to the paper stock of a small amount of an alumina source, for example, papermaker's alum, sodium aluminate or polyhydroxyaluminum chloride, further enhances the activities observed for the three component coacervate binder system. These further improvements are observed in Figures III and IV. When an alumina source is used, it is preferred to be used at levels ranging from about 0.01 to about 10.0 pounds active $Al_2O_3$ per ton of paper (dried) manufactured.

Example III

A trial was run at a paper mill in the upper Mideast while this mill was making 67.5 pounds per ream alkaline fine paper. The stock consisted of hardwood Kraft and softwood Kraft fiber with 20% filler loading comprised of an admixture of calcium carbonate, Kaolin, and titanium dioxide. Fillers were added to the pulper. Paper stock pH was 7.5. Polyhydroxyaluminium chloride was added to the save-all with the reclaimed fiber and clarified water returning to the stock system.

Cationic potato starch having a degree of substitution of 0.025 was added to the recycled white water prior to final stock dilution. The same high molecular weight anionic polyacrylamide (PAM) as used before was added to the intake of the centri-screen. Colloidal silica in the form of a 15% sol having a particle size of from 4–5 nanometers was added immediately before the headbox.

At the start of the trial period, stock treatment (I) was 18 #/T cationic potato starch and 2.0 #/T PAM. After 1.25 hours 0.8 #/T of colloidal silica was added to the system. Drainage on the fourdrinier wire increased. The "wet line" receded 2 to 3 feet and couch vacuum dropped from 22 to 19 psi. This facilitated an increase in dilution water stream flow from 1560 to 1627 gallons/-minute. Jordan refining was increased from 20 to 31 Amps. First pass retention increased from 86 to 91.5%. Headbox consistency decreased from 1.05% to 0.69%. These changes resulted in a considerable improvement in sheet formation. Sheet moisture before the size press dropped from 6 to 1%. Approximately 28 psi of steam was removed from the main drying section to hold sheet moisture at the size press to 5%.

Two hours after the start of the trail, cationic starch dosage was increased to 25 #/T, PAM dosage was increased to three (3) pounds per ton and colloidal silica dosage was reduced to 0.45 #/T (Stock Treatment II). First pass retention held at 89.5%, drainage on the wire, sheet drying and sheet formation remained essentially unchanged.

An increase in drainage and reduction in dryer steam usage can be utilized by increasing machine speed, hence, increased production rate, or by improved sheet formation with savings in steam costs. The latter option was adopted during the trial.

No significant change in sheet strength with regards to tensile, Mullen or Scott Bond was evident, as shown below for these two treatments.

| | TREATMENT | |
|---|---|---|
| | I | II |
| Basis Weight | 67.5# | 67.5# |
| Tensile | 25.0 | 24.0 |
| Mullen | 38.0 | 36.0 |
| Scott Bond | 170.0 | 197.0 |

Example IV

Comparison of Results When Silica Sol was Added Prior to Anionic Polymer

During the same trial period at the paper mill operation reviewed above, the dispersed silica injection point was moved to the inlet of the centri-screen. Previously, this silica sol injection point was at the discharge end exiting the centri-screen. Originally, the injection of dispersed silica followed both the injection of the cationic starch and the injection of the anionic polymer into the paper stock.

With the silica sol injected at the inlet of the centriscreen, the sol was being injected into the paper stock prior to the injection of the anionic polymer. Within 30 minutes of this change being made, the following negative observations were made:

1. Drainage on the fourdrinier was drastically reduced as evidenced by the thruput in the headbox. Typical flows prior to the above change ranged between about 1700–1800 gallons per minute. With the silica being added prior to the anionic copolymer, the thruput fell drastically to about 900 gallons per minute.

2. Paper formation was poor. This was evidenced by the inability of the furnish to drain accompanied by the inability to put more refining on the furnish.

3. Poor drainage and increased energy consumption indicated a poor result. The paper sheet became wetter and the steam usage in the main dryer section increased by at least 15–20 psi.

4. First pass retention worsened as evidenced by increased solids in both the tray waters and the flotation save-all.

5. Machine speed was necessarily reduced by about 8–10%.

It would then appear that the anionic combination of the anionic polymer and dispersed silica most preferably occurs by sequentially adding to the paper stock from 10 to 50 pounds per ton of dried paper of the cationically modified starch, then adding the anionic polymer; followed thereafter by the dispersed silicas. Prior addition of dispersed silica to paper stock containing polymer does not apparently allow formation of the coacervate complex, and the results of binder use is destroyed.

All of the calculations indicating the addition of any ingredient in terms of #/T above refers to the pounds of active ingredients used per ton of dried paper.

Having described my invention, I claim:

1. In a paper-making process in which paper-making stock containing a sufficient amount of cellulosic pulp to give a finished paper containing at least 50% cellulosic fiber is formed and dried; and in which the stock, prior to formation of the sheet, is admixed with from 0.1 to 15% based on the weight of said pulp of a binder, the improvement which comprises using a coacervate binder comprising a cationic starch having a degree of substitution ranging between about 0.01 to about 0.20 in combination with an anionic combination of an anionic high molecular weight polymer having a molecular weight of at least 500,000 and a degree of anionic substitution of at least 0.01 and a dispersed silica having a particle size ranging from 1 to 50 nm; and wherein the weight ratio of anionic polymer to silica ranges between about 20:1 to about 1:10, and further, where the cationic starch to silica ratio is between about 100:1 to 1:1.

2. The process of claim 1 in which ratio of cationic starch to anionic combination ranges between about 50:1 to about 5:1 and the weight ratio of anionic polymer to silica sol ranges between about 10:1 to about 1:1, and also wherein the degree of anionic substitution of the anionic polymer is at least 0.10, and the molecular weight of the anionic polymer is at least 1,000,000; the degree of cationic substitution on the cationic starch is from about 0.02–0.10; and the particle size of the dispersed silica ranges from 2–25 nm.

3. The process of claim 2 wherein the pH of the paper stock ranges between about 4 to 9.

4. The process of claim 3 wherein the degree of cationic substitution of starch ranges between about 0.015 to about 0.075 and the cationic starch is a cationically modified potato starch, and wherein the anionic polymer is from the group consisting of copolymers of acrylamide with monomers from the group consisting of acrylic acid, methacrylic acid, AMPS, vinyl sulfonate, sulfonated styrene and mixtures thereof, and modified acrylamide polymers containing at least the sulfonate functional group.

5. In the process of claim 1 or 2, the improvement which comprises forming the binder in situ by a sequential addition to the paper-making stock of the cationic starch, then the anionic polymer then the dispersed silica; each addition occurring after each prior addition has been thoroughly admixed with the paper-making stock.

6. In the process of claim 1 or 2, the improvement which comprises forming the binder in situ by a sequential addition to the paper-making stock of the cationic starch, followed then by an admixture of the silica sol and the anionic polymer; each addition occurring after each prior addition has been thoroughly admixed.

7. In the process of claim 1, the improvement which comprises additionally adding to the paper stock from 0.01 to 10.0 pounds of active alumina, $Al_2O_3$ per ton of dried paper.

8. The process of claim 7 wherein the active alumina is chosen from the group consisting of papermaker's alum, sodium aluninate, or polyhydroxyaluminum chloride.

9. In a paper-making process in which an aqueous paper-making stock containing a sufficient amount of cellulosic pulp to provide a paper having at least 50 weight percent cellulosic fiber has added thereto prior to sheet formation a binder and a mineral filler/pigment material having at least partial anionic surface characteristics, the improvement which consists of adding to said paper-making stock, prior to sheet formation, a coacervate binder consisting of a cationically modified potato starch having a degree of cationic substitution ranging between about 0.01 to about 0.15 in combination with an anionic polymer having a molecular weight of at least 1,000,000 and a degree of anionic substitution ranging between about 0.05 to about 0.95, and further in combination with a dispersed silica having a particle size ranging between about 1 nm to about 50 nm, wherein the cationic starch to silica ratio is between 100:1 to about 30:1; the anionic combination has a weight ratio of polymer; silica ranging between about 20:1 to about 1:1, and further wherein the total coacervate binder to mineral filler weight ratio, on a solids basis, is between 0.005:1 to about 1:1, and further wherein said binder is formed by admixing with paper-making stock, in sequence, the cationic starch, the anionic polymer, and then the dispersed silica and wherein the paper-making stock contains the cellulosic pulp having dispersed therein the mineral filler.

10. The process of claim 9 wherein the pH of the paper-making stock ranges between about 4 to 9.

11. The process of claim 9 wherein the weight ratio of cationically modified potato starch to the anionic combination of anionic polymer and dispersed silica is between about 50:1 to 1:1 and the weight ratio of cationic starch to silica is between about 75:1 to 30:1, and further wherein the binder, on a solids level, is added to said paper-making stock at levels ranging between about 0.05 to about 10 weight percent of said paper-making stock.

12. The process of claim 11 wherein the ratio of cellulosic fibers to mineral filler ranges between about 100:1 to about 1:1 and wherein the ratio of cellulosic fibers to binder is about 200:1 to about 20:1, and wherein the silica particles have a particle size ranging from 1.0 to about 10 nm, the anionic polymer has a molecular weight of at least 5,000,000 and a degree of anionic substitution ranging between about 0.05 to about 0.50 and wherein the potato starch contains a degree of cationic substitution ranging between about 0.01 to about 0.10.

13. An improved process of claim 11 in which form 0.01 to 10.0 pounds of active alumina chosen from the group consisting of papermaker's alum, sodium aluminate, and polyhydroxyaluminum chloride, and mixtures thereof is additionally added per ton of dried paper to the paper stock.

* * * * *